US005322497A

United States Patent [19]

Kobayashi

[11] Patent Number: 5,322,497

[45] Date of Patent: Jun. 21, 1994

[54] CENTRIFUGAL SEPARATOR AND AUTOMATIC CENTRIFUGAL SEPARATOR SYSTEM

[75] Inventor: Sakae Kobayashi, Hirakata, Japan

[73] Assignee: Matsushita Electric Industrial Co. Ltd., Osaka, Japan

[21] Appl. No.: 703,459

[22] Filed: May 21, 1991

[30] Foreign Application Priority Data

May 23, 1990 [JP] Japan ..... 2-131195

[51] Int. Cl.[5] ..... B04B 5/02

[52] U.S. Cl. ..... 494/20; 494/7; 494/84; 494/60

[58] Field of Search ..... 494/1, 10, 16, 17, 20, 494/21, 42, 46, 60, 83, 84, 37, 7

[56] References Cited

U.S. PATENT DOCUMENTS

| | | | |
|---|---|---|---|
| 1,680,259 | 8/1928 | Spencer et al. | 494/84 |
| 2,507,309 | 5/1950 | Larsson | 494/16 |
| 3,151,073 | 9/1964 | Anthon | 494/16 |
| 3,712,535 | 1/1973 | Genese et al. | 494/17 |
| 4,030,834 | 6/1977 | Bauer et al. | 494/10 |
| 4,032,066 | 6/1977 | Wright | 494/20 |
| 4,135,660 | 1/1979 | Conn et al. | 494/20 |
| 4,172,339 | 10/1979 | Balz | 494/17 |
| 4,244,513 | 1/1981 | Fayer et al. | 494/16 |
| 4,443,266 | 4/1984 | Schaper et al. | 494/1 |
| 4,449,964 | 5/1984 | Westberg et al. | 494/16 |
| 4,522,620 | 6/1985 | Leister | 494/10 |
| 4,531,652 | 7/1985 | Hara | 494/20 |
| 4,742,624 | 5/1988 | Grant | 494/84 |
| 4,746,210 | 5/1988 | DiFoggio et al. | 494/10 |
| 4,990,130 | 2/1991 | Prais | 494/20 |
| 5,133,208 | 7/1992 | Ricci | 494/16 |
| 5,221,250 | 6/1993 | Cheng | 494/10 |

FOREIGN PATENT DOCUMENTS

| | | | |
|---|---|---|---|
| 2141051 | 12/1984 | United Kingdom | 494/17 |

*Primary Examiner*—Timothy F. Simone
*Assistant Examiner*—James F. Hook
*Attorney, Agent, or Firm*—Ratner & Prestia

[57] ABSTRACT

A centrifugal separation process which is made continuous and automatic by determining the position for taking out the liquid container (8) accurately within a short time, with a liquid container (8) containing liquid for separation being kept by a basket (7) which is suspended and freely rotatable on the tip of a rotary arm (6), by positioning a circumferential direction of the rotary arm (6) by means of a rotary arm direction detector and a rotary arm positioning device and by stopping a basket (7) horizontally at a predetermined position by a basket positioning device (14).

6 Claims, 3 Drawing Sheets

CENTRIFUGAL SEPARATOR AND AUTOMATIC CENTRIFUGAL SEPARATOR SYSTEM

BACKGROUND OF THE INVENTION

The present invention relates to a centrifugal separator for centrifugal separation and sedimentation of liquid and to an automatic centrifugal separator for automatic separating work.

Explanation follows of a conventional centrifugal separator with reference to FIG. 7 and FIG. 8.

FIG. 7 illustrate a side-view cross section of the conventional centrifugal separator, and FIG. 8 is a plan view of a major part thereof. In FIG. 7, the conventional centrifugal separator has a main body which is partitioned into upper and lower chambers as a processing chamber 1*b* and a driving chamber 1*c* respectively by a floor 1*a* provided on the middle stage, comprising; a cover 2 for sealing the aforementioned processing chamber 1*b* having a locking device 2*a* and being pivoted for free opening and closing through a hinge at an upper opening of the processing chamber 1*b*, a spindle shaft 4 supported rotatively by use of a plurality of ball bearings on a housing 3 fixed on nearly the middle of the aforementioned floor 1*a*, an electric motor 5 fixed on the main body which drives the aforementioned spindle 4 through a belt transmission device and the like at the lower end, four pieces of baskets suspended by lug shafts 7*a* respectively made freely rotatable at the end of a cross rotary arm 6 which is fixed on the upper part of the aforementioned spindle shaft 4 as shown in FIG. 8, and a jig 9 which accommodates cylindrical liquid containers 8 attached to the respective baskets 7.

Explanation follows of a method for use of the centrifugal separator thus structured.

First of all, after mounting on respective jigs 9 liquid containers 8 filled with liquid for carrying out centrifugal separation or centrifugal sedimentation by first unlocking a locking device 2*a* and then opening a cover 2, locking is made with the cover 2 closed. Then, upon operating an electric motor 5 with a button operation made, a rotary arm 6 fixed on a spindle shaft 4 rotates, and a basket 7 supported at the lug shaft 7*a* is rotated outward by a centrifugal force and is rotated by keeping the liquid container 8 in a horizontal position. After operating it for a certain period of time, operation is stopped with a button operation. After a complete stop, the liquid containers 8 are taken out by opening the cover 2 after releasing the locking device 2*a*.

It is common that the separation process is carried out after arranging a plurality of centrifugal separators. However, in the structure thus mentioned above, the stop position of the rotary arm 6 is not constant and a direction of jig 9 being suspended can not be ascertained, and furthermore, there was a problem that automation was difficult due to complexity of an opening and closing operation of the cover 2. Furthermore, a separation process in which a plurality of centrifugal separators are arranged had variations in time for changing the liquid container 8 for each centrifugal serrating process, which made it difficult to keep the time of centrifugal separation process constant.

SUMMARY OF THE INVENTION

The purpose of the present invention is to solve the above problem, and to provide a centrifugal separator capable of making a stop position of rotary arm 6 constant, making it easy to open and close a processing chamber 1*b* for changing liquid containers 8, and making an automatic operation possible, and also to provide an automatic centrifugal separator which uses those devices. That is, the present invention is to provide on a spindle shaft 4 a direction detection device of a rotary arm direction for determining a position in a circumferential direction of the rotary arm 6 and a rotary arm positioning device for accurately detecting a stop position, and furthermore, to provide a basket positioning device for determining a suspended direction of basket 7 together with providing a small cover having an opening and closing device of cover 2.

Likewise, arranging in constant pitch a plurality of centrifugal separators on the outer periphery of a rotating table which rotates intermittently, an automatic centrifugal separator comprises in combination, a conveyor to supply liquid containers, a transfer device to change new liquid containers with separated liquid containers, and injector device for processed liquid.

With the structure above, the basket comes to stop accurately under the small cover by the aid of direction detection device of a rotary arm, rotary arm positioning device and basket positioning device, and upon opening the small cover having a open and close device, supply and taking off of a liquid container 8 which are mounted on the jig 9 of the basket 7 are automatically made.

Also, centrifugal separation can continuously and automatically be made if the aforementioned centrifugal separator is arranged on the periphery of the rotating table at a constant pitch which rotates intermittently and also an automatic supply device is provided.

DETAILED DISCLOSURE OF THE INVENTION

Explanation follows of one embodiment of the present invention with reference to FIG. 1 through FIG. 6.

Figure 1:
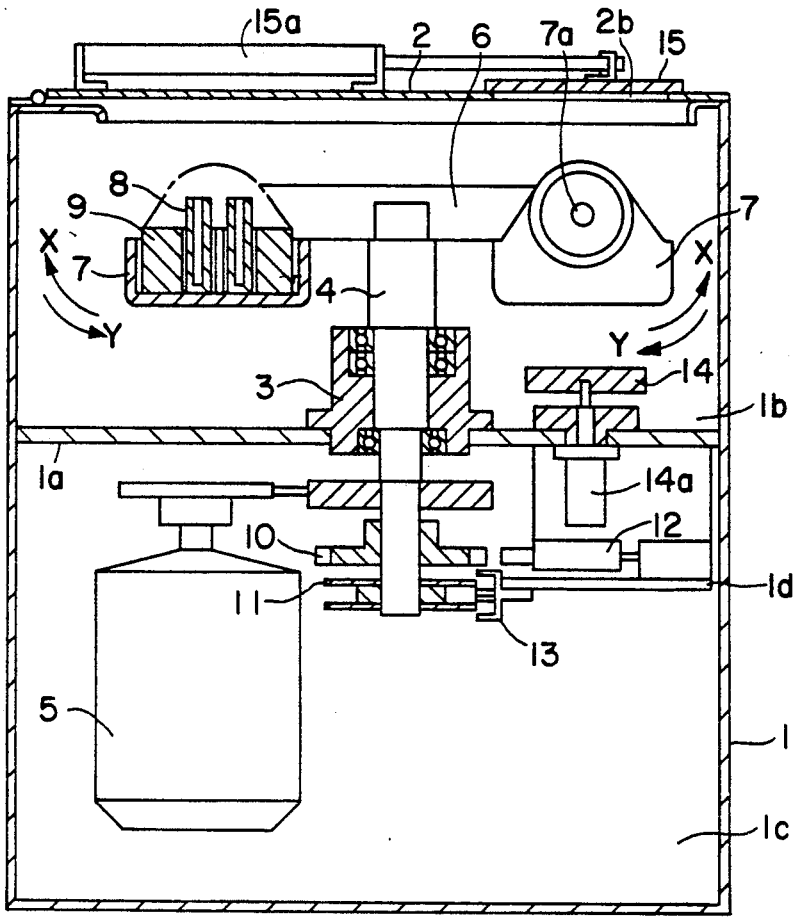
FIG. 1 and FIG. 2 illustrate a side-view cross section and a plan-view of the centrifugal separator of the present invention.
Figure 7:
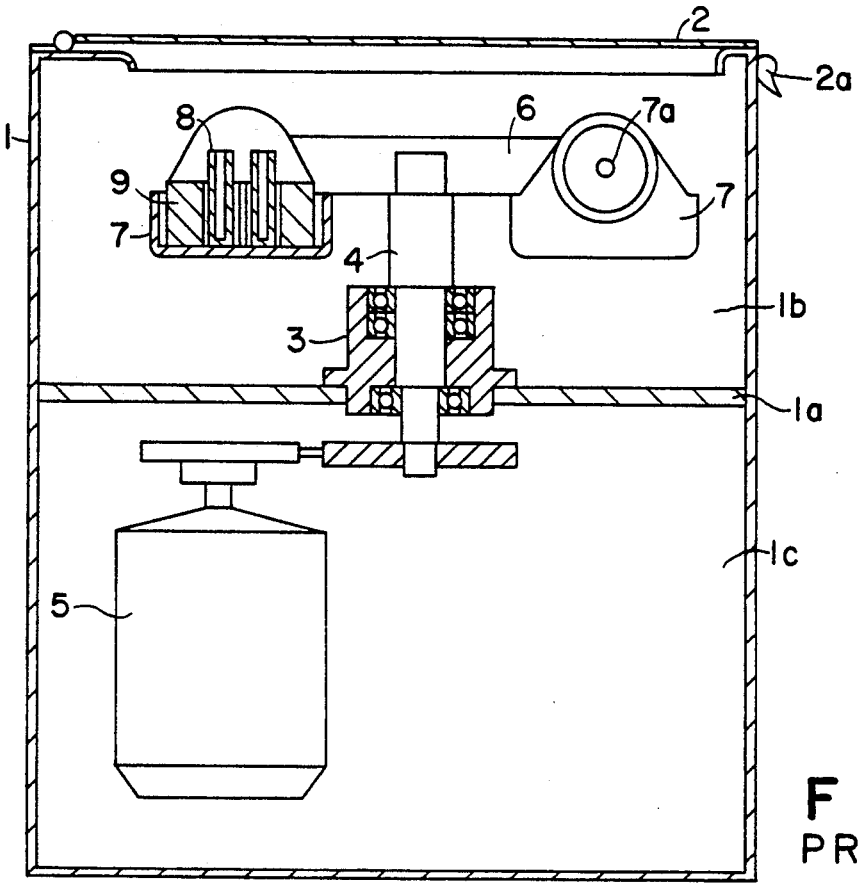
FIG. 7 PRIOR ART
FIG. 7 and FIG. 8 illustrate a side-view cross section and a plan-view of major part of the conventional separator of the prior art.
Figure 8:
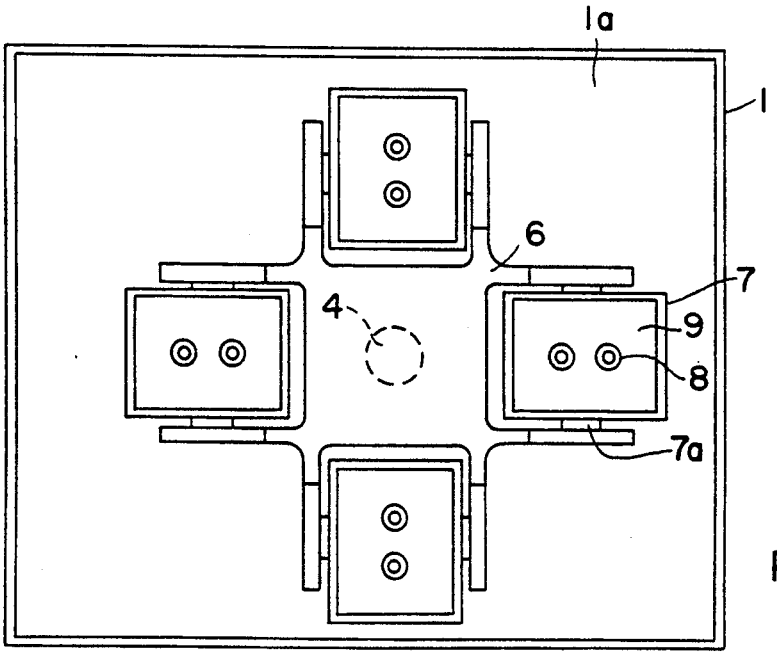
FIG. 8 PRIOR ART

In FIG. 1, the different points in the centrifugal separator of the present invention from the conventional example shown in FIG. 7 are; a positioning plate 10 of rotary arm positioning device and a detection plate of a direction detection device are fastened on the lower end of spindle shaft 4 and, furthermore, a stopper device 12 of rotary arm positioning device and a detector 13 of direction detection device are fastened on a mounting rack 1*d* fastened on a floor 1*a*; a basket positioning device 14 is provided for determining a suspended position of the basket 7 which freely moves up and down by an actuator 14*a* fixed on the floor 1*a*; an opening 2*b* is provided on the cover 2 for exchanging the liquid container 8 and a small cover 15 is provided thereon which opens and closes by freely sliding with the aid of an actuator 15*a*. As there are no further points which differ from the conventional examples, same symbols are affixed to the same structural parts and then such explanation is omitted.

Figure 2:
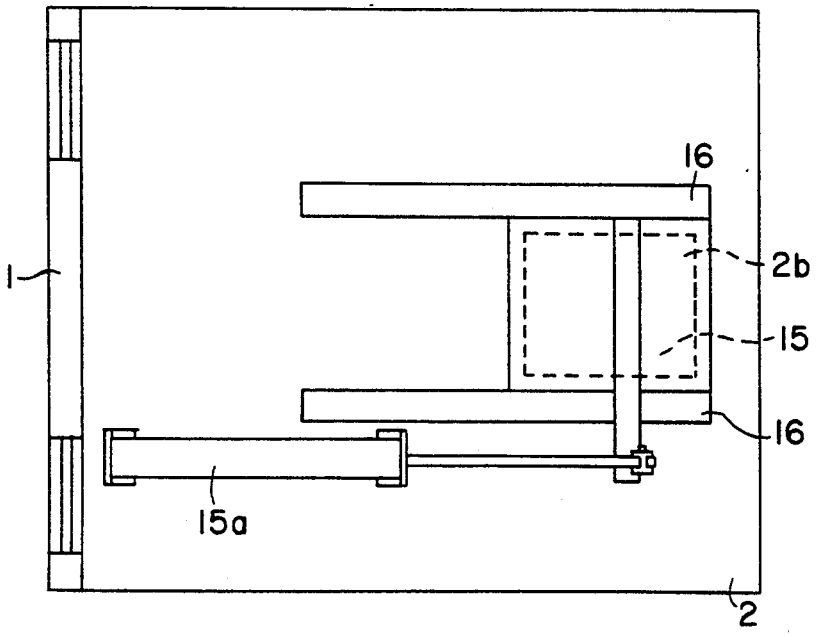
Figure 3:
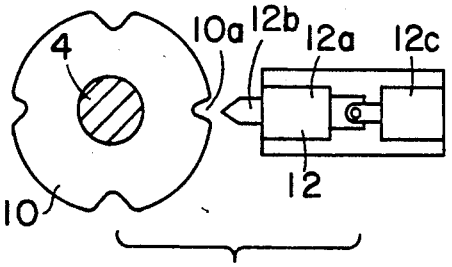
FIG. 3 and FIG. 4 illustrate plan-views of rotary arm positioning device and direction detection device.
Figure 4:
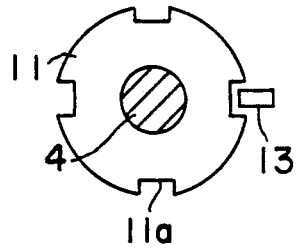

As shown in FIG. 2, the small cover 15 as provided on the cover 2 freely slides guided by two guide rails 16 which are parallel with the actuator 15*a* and opens and closes the window 2*b* as shown with a broken line. Likewise, as shown in FIG. 3, a positioning plate 10 for the afore-mentioned rotary arm positioning device is provided with 4 V-grooves on the circumference so that it conforms to an arm direction of the rotary arm 6, and a stopper device 12 is composed of a stopper 12*b* whose top is a wedge-shape being freely and slidably engaged with a guide block 12*a* and of its driving part 12*c*. Also, as shown in FIG. 4, a detection plate 11 of the direction detection device is provided with 4 square-type cutouts 11*a* in the same direction as the V-groove 10*a* of the above positioning plate 10, and the detector 13 mounted on the mounting rack 1*d* is fixed in such a manner that it mates with the aforementioned cutout 11*a*.

Figure 5:
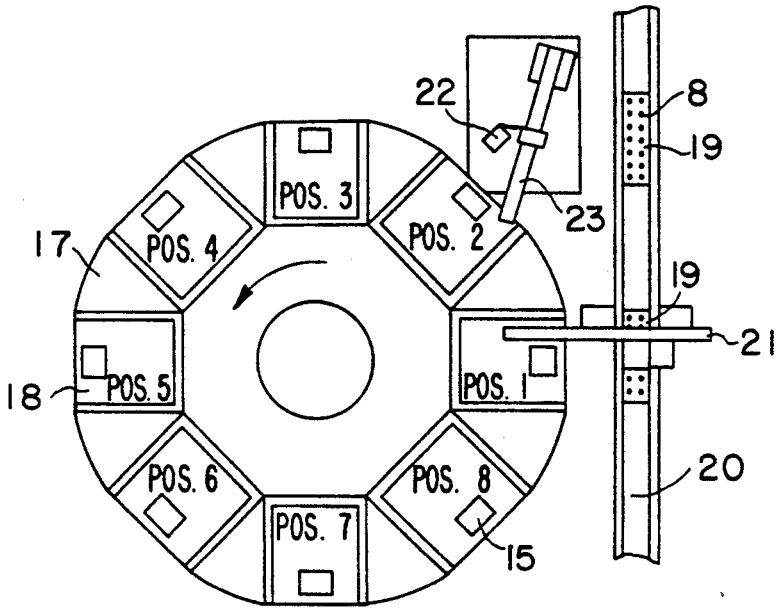
FIG. 5 and FIG. 6 illustrate a plan-view and a side-view of an automatic centrifugal separator of the present invention.
Figure 6:
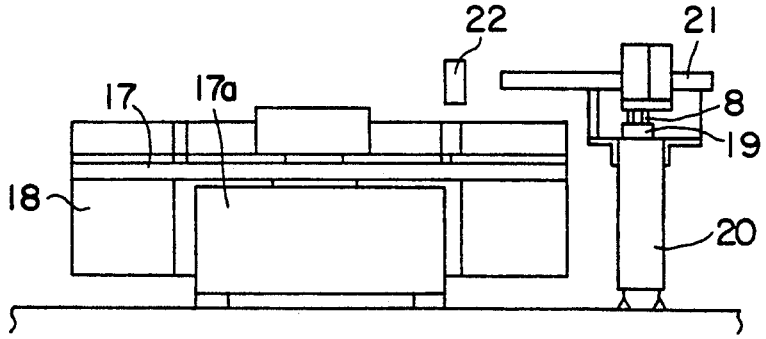

Then, explanation follows below of an automatic centrifugal separator. In FIG. 5 and FIG. 6, the automatic centrifugal separator of the present invention is provided respectively with a transfer industrial robot 21 which transfers the liquid container 8 between a jig 9 (not indicated in the Figure) of the centrifugal separator 18 of above POS. 1 and the aforementioned pallet 19, and an industrial robot 23 for injection liquid which transfers an injection nozzle 22 for supplying a predetermined volume of liquid to be separated to the liquid container 8 (not indicated in the Figure) of the centrifugal separator of POS.2, with a plurality (8 sets of the present embodiment) of centrifugal separators 18 mounted on the outer periphery of an intermittently rotating rotary table 17 and also with a belt conveyor 20, in which liquid container 8 loaded with a pallet 19 is delivered or carried out in front of the centrifugal separator 18 as shown with POS. 1 in the Figure.

Explanation follows of the operation on the automatic centrifugal separator thus structured. A vacant liquid container 8 contained in a pallet 19 is transferred from the preceding process through a belt conveyor 20 and reaches in front of a centrifugal separator 18 of POS.1. On the other hand, a rotary arm 6 of the centrifugal separator 18 of POS.1 is positioned by a direction detection device and a stopper device, and a jig 9 is positioned vertically by a basket positioning device 14 and, furthermore, a small cover 15 is opened by an actuator 15*a*.

Then, a transfer industrial robot 21 is operated, and it transfers a vacant container 8 to a jig 9 inside the centrifugal separator 18 of POS.1 from a pallet 19. Following this, an electric motor 5 is operated and after the rotary arm 6 is rotated by 90°, an adjacent basket 7 stops under a window 2*b* through the same positioning process, and the vacant liquid container 8 is mounted on the jig 9. With such operation repeated 4 times, the liquid container 8 is mounted on all the jigs 9 on the centrifugal separator 18 of POS.1.

Then, a table driving area 17*a* is operated and the centrifugal separator 18 whose small cover 15 is kept open is transferred to POS.2 and then stops. When it is stopped, the industrial robot 23 for injection liquid is operated, an injection nozzle 22 is inserted into the liquid container 8 and then a predetermined volume of liquid to be processed is supplied. On the other hand, to the centrifugal separator 18 of POS.8 which is moved to POS.1, in the same manner as aforementioned, the vacant liquid container 8 is mounted. In the centrifugal separator 18 of POS.2, in the same manner as above, injection operation is repeated by 4 times and the liquid to be processed is injected to liquid container 8 of all the jigs 9. After the injection is completed, the actuator 15*a* is operated and then a small cover 15 is closed. Then, table driving area 17*a* is operated, and the centrifugal separator 18 of POS.2 is transferred to the next POS.3. From POS.3 to POS.8, an electric motor 5 rotates a rotary arm 6 continuously and a centrifugal separation process is carried out, and then completes one cycle by returning to POS.1.

In the following cycle, a transfer industrial robot 21 accommodates centrifugally separated liquid container 8 in a pallet 19, and mounts the vacant liquid container 8. The above operation is repeated continuously for all the centrifugal separators 18.

As explained above, according to the present invention, a centrifugal separator is obtained in which jigs mounted on the basket stop accurately under the small covers by means of the direction detection device, rotating arm positioning device and basket positioning device, and small covers are automatically opened.

Also, by arranging a plurality of centrifugal separators at a certain pitch around the outer periphery of an intermittently rotating rotary table, and, furthermore, setting a conveyor and an industrial robot, the centrifugal separator can be continuously and automatically operated, thus making it possible to keep a time required for centrifugal separation constant, and also making an accurate separation process possible.

What is claimed is:

1. A centrifugal separator, comprising:

a main body having a processing chamber sealed with a cover which is freely opened/closed vertically and is mounted on an upper opening thereof, a rotary arm fastened on the upper end of a rotating shaft supported rotatively by a housing fixed on the floor of said processing chamber, a basket suspended freely and rotatively by a shaft on the end of said rotary arm;

a jig which contains a liquid container for liquid separation installed on said basket, and a rotating shaft driving device for driving said rotating shaft arranged under said floor, a positioning plate fastened to the lower end of said rotating shaft, a stopper device for engaging said positioning plate, said stopper device fastened to a mounting rack fastened on the main body, said positioning plate and said stopper device for accurately positioning said rotary arm in a stopped position in one of a plurality of predetermined orientations, a detection plate fastened to the lower end of said rotating shaft, a detection device fastened to the mounting rack fastened on the main body, said detection plate and said detection device for detecting said one of said plurality of predetermined orientations of said rotary arm, and a basket positioning device installed onto said floor for moving said jig installed on said basket wherein said basket is moved vertically to a predetermined position.

2. A centrifugal separator according to claim 1, wherein:

said positioning plate has a plurality of slots, each of said slots formed at a different location along the periphery of said positioning plate;

said stopper device includes a stopping member which extends so as to engage any one of said plurality of slots so as to position said rotary arm in one of said plurality of predetermined orientations.

3. A centrifugal separator according to claim 1, further comprising another basket suspended on another end of said rotary arm, wherein said basket positioning device separately moves each one of said basket and said further basket to said predetermined position.

4. A centrifugal separator, comprising:

a main body having a processing chamber sealed with a cover which is freely opened/closed vertically and is mounted on an upper opening thereof, a rotary arm fastened on the upper end of a rotating shaft supported rotatively by a housing fixed on the floor of said processing chamber, a basket suspended freely and rotatively by a shaft on the end of said rotary arm;

a jig which contains a liquid container for liquid separation installed on said basket, and a rotating shaft driving device for driving said rotating shaft arranged under said floor, a positioning plate fastened to the lower end of said rotating shaft, a stopper device for engaging said positioning plate, said stopper device fastened to a mounting rack fastened on the main body, said positioning plate and said stopper device for accurately positioning said rotary arm in a stopped position in one of a plurality of predetermined orientations, a detection plate fastened to the lower end of said rotating shaft, a detection device fastened to the mounting rack fastened on the main body, said detection plate and said detection device for detecting said one of said plurality of predetermined orientations of said rotary arm, and a basket positioning device installed onto said floor for moving said jig installed on said basket wherein said basket is moved vertically to a predetermined position, and a small cover having an opening and closing device mounted on said small cover for covering said window.

5. A centrifugal separator according to claim 4, wherein:

said positioning plate has a plurality of slots, each of said slots formed at a different location along the periphery of said positioning plate;

said stopper device includes a stopping member which extends so as to engage any one of said plurality of slots so as to position said rotary arm in one of said plurality of predetermined orientations.

6. A centrifugal separator according to claim 4, further comprising another basket suspended on another end of said rotary arm, wherein said basket positioning device separately moves each one of said basket and said further basket to said predetermined position.

* * * * *